US006689182B2

(12) United States Patent
Tokuda et al.

(10) Patent No.: US 6,689,182 B2
(45) Date of Patent: Feb. 10, 2004

(54) METHOD AND DEVICE FOR PRODUCING MOLTEN IRON

(75) Inventors: Koji Tokuda, Osaka (JP); Shuzo Ito, Osaka (JP); James C. Simmons, Pittsburgh, PA (US); Robert F. Edgar, Pittsburgh, PA (US)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/965,857

(22) Filed: Oct. 1, 2001

(65) Prior Publication Data

US 2003/0070507 A1 Apr. 17, 2003

(51) Int. Cl.[7] ..... C21B 11/10
(52) U.S. Cl. ..... 75/10.66; 75/10.62; 266/44
(58) Field of Search ..... 266/44; 373/80, 373/104; 75/10.1, 10.62, 10.63, 10.66

(56) References Cited

U.S. PATENT DOCUMENTS

| | | | | |
|---|---|---|---|---|
| 3,033,673 | A | 5/1962 | Collin et al. | |
| 3,443,931 | A | 5/1969 | Beggs et al. | |
| 3,857,697 | A | 12/1974 | Antoine et al. | |
| 4,098,603 | A | 7/1978 | Roth et al. | |
| 4,119,454 | A | * 10/1978 | Rath | 75/10.66 |
| 4,122,295 | A | * 10/1978 | Nanjyo et al. | 373/80 |
| 4,238,226 | A | 12/1980 | Sanzenbacher et al. | |
| 4,238,632 | A | * 12/1980 | Yasukawa et al. | 373/80 |
| 4,316,739 | A | 2/1982 | Beggs et al. | |
| 4,701,214 | A | 10/1987 | Kaneko et al. | |
| 5,567,224 | A | 10/1996 | Kundrat | |
| 5,989,019 | A | 11/1999 | Nishimura et al. | |
| 6,015,527 | A | 1/2000 | Kamei et al. | |
| 6,036,744 | A | 3/2000 | Negami et al. | |
| 6,063,156 | A | 5/2000 | Negami et al. | |
| 6,129,777 | A | 10/2000 | Fuji et al. | |
| 6,149,709 | A | 11/2000 | Uragami et al. | |
| 6,152,983 | A | 11/2000 | Kamijo et al. | |
| 6,241,803 | B1 | 6/2001 | Fuji | |
| 6,251,161 | B1 | 6/2001 | Tateishi et al. | |
| 6,254,665 | B1 | 7/2001 | Matsushita et al. | |
| 6,258,149 | B1 | 7/2001 | Sugiyama et al. | |
| 6,296,479 | B1 | 10/2001 | Nishimura et al. | |
| 6,334,883 | B1 | 1/2002 | Takenaka et al. | |
| 6,368,379 | B1 | 4/2002 | Tateishi et al. | |
| 2001/0043640 | A1 | 11/2001 | Shimizu et al. | |

FOREIGN PATENT DOCUMENTS

| | | |
|---|---|---|
| GB | 1 502 992 | 3/1978 |
| WO | WO 00/29628 | 5/2000 |

OTHER PUBLICATIONS

The Making, Shaping and Treating of Steel, 10$^{th}$ edition, Dec. 1989, pp 635–649 and 660–664.*
National Carbon Company Brochure, Aug. 1951.*

* cited by examiner

*Primary Examiner*—Scott Kastler
(74) *Attorney, Agent, or Firm*—Oblon, Spivak, McClelland, Maier & Neustadt, P.C.

(57) ABSTRACT

A method capable of suppressing damages to furnace wall refractories in a melting furnace and making the working life of them longer and a technique capable of obtaining a molten iron with homogenized composition while keeping a high productivity upon arc heating a pre-reducing iron in a melting furnace to obtain a molten iron, the method comprising supplying a pre-reducing iron to a stationary non-tilting type melting furnace and melting the iron by an arc heating mainly composed of radiation heating, the melting being performed while keeping a refractory wearing index RF represented by the following equation at 400 MWV/m$^2$ or less.

$$RF=P\times E/L^2$$

(wherein RF represents the refractory wearing index (MWV/m$^2$); P represents an arc power for one phase (MW); E represents an arc voltage (V); and L represents the shortest distance between the electrode side surface of a tip within an arc heating furnace and a furnace wall inner surface (m).)

19 Claims, 6 Drawing Sheets

METHOD AND DEVICE FOR PRODUCING MOLTEN IRON

BACKGROUND OF THE INVENTION

1. Field of the Invention

This invention concerns a technique of producing molten iron by arc heating of pre-reducing iron. More specifically, it relates to a technique of supplying pre-reducing iron to a stationary non-tilting type melting furnace and melting the iron by arc heating mainly comprising radiation heating, in which molten iron at stable quality is produced at a high efficiency while improving the life of refractory in the melting furnace.

2. Description of the Related Art

As a method of producing liquid iron (molten iron) by heating solid iron, a technique of charging solid iron into a melting furnace such as an electric furnace and melting them by arc as a heating source has been known so far. Further, direct reduced iron has been used as the solid iron in recent years.

Reduced iron is produced basically by reducing iron oxide sources such as iron ores and various methods have been proposed so far for producing reduced iron. For example, direct iron making process of producing reduced iron by directly reducing iron oxide sources such as iron ores or iron oxide pellets by reducing agents such as carbon materials or reducing gases have been known. A shaft furnace process, an SL/RN process or the like can be listed as an example of the direct iron making process. The shaft furnace process can include a Midrex process as a typical example. In this process, an iron oxide source in a furnace is reduced by blowing a reducing gas produced, for example, from a natural gas through a tuyere disposed at a lower portion of the shaft furnace, which is a technique of reducing the iron oxide source by utilizing the reducing gas. In the SL/RN process, carbon material such as coal is used as the reducing agent and the carbon material is heated together with the iron oxide source such as iron ores by a heating means such as a rotary kiln to reduce the iron oxide source. In addition, as the direct iron making process other than those descried above, U.S. Pat. No. 3,443,931 describes, for example, a method of mixing a carbon material and iron oxide fines into compacts and heating them on a hearth to reduce the iron oxide.

Further, it has also been known a method of mixing a carbon material and iron oxide fines into compacts, reducing them under heating on a rotary hearth and further melting and separating the resultant reduced iron into a slag component and a metallic iron component to produce a high purity metallic iron as disclosed, for example, in U.S. Pat. No. 6,036,744, Japanese Patent Laid-open Application No. Hei 9-256017, Japanese Patent Laid-open Application No. Hei 12-144224. Direct reduced iron produced by reducing iron oxide sources as described above are frequently used in the technique of producing molten iron.

An electric furnace and a submerged arc furnace can be shown as examples of the melting furnace for melting direct reduced iron. For example, in a tilting type melting furnace, a furnace body has to be tilted upon discharge of molten iron in which a batch treatment is conducted. In a case of transporting direct reduced iron produced continuously in a reduced iron production plant directly to a melting furnace where solid direct reduced iron is melted, continuous processing can not be conducted by a single tilting type melting furnace and it is not preferred with a view point of ensuring operation at high productivity. If several tilting type melting furnaces are used and direct reduced iron is supplied continuously to them, it is possible to continuously melt direct reduced iron. However, the scale of the facility has to be enlarged for installing several tilting type melting furnaces. In addition, since the tilting device for tilting the furnace has a complicate structure, it increases the construction cost, as well as operation cost and maintenance cost for operating several furnaces.

Further, in a case of the tilting type melting furnace, relatively small sized furnaces are used with a view point of the scale of the facility and the construction cost, because the size of the tilting device for the furnace is increased when the furnace with a large inner diameter is used. However, when direct reduced iron is melted by a small-sized tilting type melting furnace, furnace wall refractories in contact with molten slags suffer from erosion by arc radiation, and periodical repairing is necessary to the refractories, and the operation has to be interrupted.

Further, direct reduced iron supplied contains slag component such as SiO, $Al_2O_3$ and CaO derived from gangue in the iron ores used as the raw material and ashes in the carbon material, and the composition of them and the reduction rate vary with time depending on the fluctuation of operation conditions in the reducing furnace and the like.

Accordingly, when the direct reduced iron is melted by a small sized tilting type melting furnace, it results in a problem that the composition of the molten iron produced are different on every batch. Further, for overcoming the difference in the composition of the molten iron on every batch as described above, the molten iron is discharged after controlling the composition in the furnace. However, an excess electric energy is required for preventing lowering of molten iron temperature during such control for the composition. In addition, since the control for the composition is conducted in the furnace, operation time required per batch increases to inevitably lower the productivity. As described above, when the tilting type melting furnace is used, there are various problems in ensuring operation at high productivity.

Further, in a case of melting direct reduced iron at, for example, a submerged arc furnace, top ends of electrodes are submerged in a slag layer as shown in FIG. 4 and electric current is supplied, to generate Joule heat among the solid reduced iron in the slag layer or on the slag layer to melt the iron. However, since the resistance lowers as the metallization of the reduced iron to be melted is higher, the energy consumption for melting the direct reduced iron has to be increased, which results in lowering the productivity. Particularly, when the solid reduced iron is fed not uniformly in the furnace, the surface of the slag layer is overheated to cause an accident of leaking molten iron or molten slag from the furnace, so that careful operations have been required for the feeding of the solid reduced iron.

In the submerged arc furnace, while the direct reduced iron can be fed continuously since molten iron can be discharged properly from the bottom of the furnace, the productivity for the molten iron is low as described above. Accordingly, in existing submerged arc furnaces, the scale of the construction per unit production of molten iron is increased such as by the use of a large sized furnace for ensuring production amount, but since the use of the large sized furnace increases the electric power consumption and construction cost, the productivity has not yet been improved.

SUMMARY OF THE INVENTION

This invention has been accomplished in view of the foregoing problems and it intends to provide a technique, for producing a molten iron by arc heating a pre-reducing iron in a melting furnace, capable of withstanding erosion to furnace wall refractory in a melting furnace to improve the working life and capable of producing a molten iron with a homogenized composition while keeping high productivity.

The technique of the present invention capable of solving the foregoing subject is a method for producing a molten iron comprising feeding a pre-reducing iron to a stationary non-tilting type melting furnace and melting the iron by arc heating mainly composed of radiation heating, the melting being performed while keeping a refractory wearing index RF represented by the following equation at 400 MWV/$m^2$ or less.

$$RF=P\times E/L^2$$

[wherein RF represents a refractory wearing index (MWV/$m^2$); P represents an arc power for 1 phase (MW); E presents an arc voltage (V); and L represents the shortest distance (m) between the electrode side surface of the tip within an arc heating type melting furnace and the furnace wall inner surface.]

Further, the present invention provides a stationary non-tilting arc heating type melting furnace for melting a pre-reducing iron by arc heating mainly composed of radiation heating, the melting furnace having a pre-reducing iron feeding mechanism, electrodes for arc heating and a molten iron discharging mechanism, the melting being performed while keeping a refractory wearing index RF represented by the following equation at 400 MWV/$m^2$ or less.

$$RF=P\times E/L^2$$

[wherein RF represents a refractory wearing index (MWV/$m^2$); P represents an arc power for 1 phase (MW); E presents an arc voltage (V) and L represents the shortest distance (m) between the electrode side surface of the tip within an arc heating type melting furnace and the furnace wall inner surface.]

$$L=ID/2-PCD/2-DE/2$$

[wherein ID represents the inside diameter (m) of the melting furnace; PCD represents an electrode pitch circle diameter (m); and DE represents an electrode diameter (m).]

DESCRIPTION OF THE PREFERRED EMBODIMENTS

Figure 1:
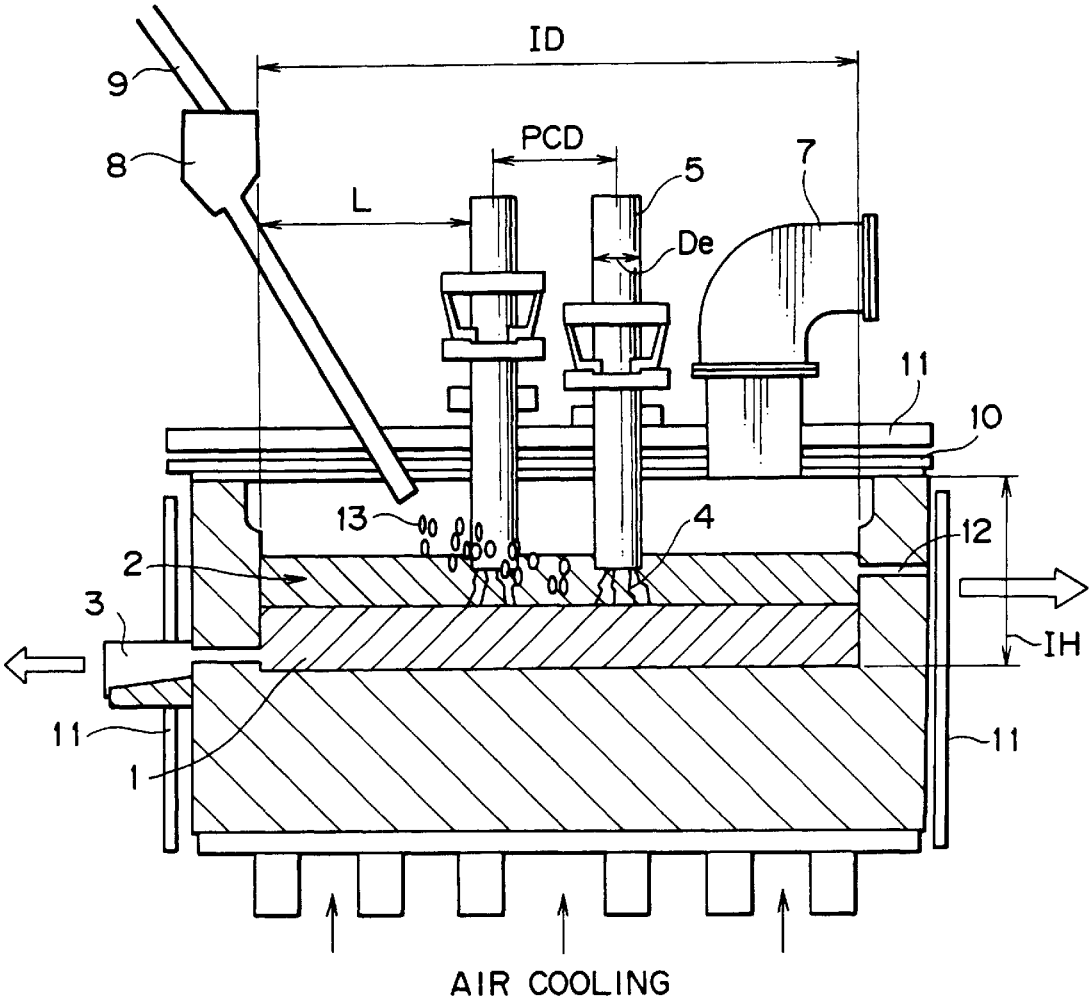
FIG. 1 illustrates a stationary non-tilting type melting furnace according to the present invention.

The melting furnace according to the present invention is to be described specifically referring to the drawings, but the invention is not restricted to the illustrated embodiments.

In the present invention, the melting furnace is a stationary non-tilting type melting furnace for melting a pre-reducing iron by arc heating mainly comprising radiation heating. Further, since the melting furnace is the stationary non-tilting type melting furnace and a furnace having a larger inside diameter compared with that of the tilting type melting furnace can be used, the distance between the electrode and the inner wall of the furnace can be ensured sufficiently such that furnace wall refractories do not suffer from erosion by the arc radiation. Further, when the top ends of the electrodes inside the furnace are controlled so as to be submerged in the molten slag layer and the arc is generated in the slag layer, the radiation heating can be kept in the slag layer to further improve the heat efficiency.

The melting furnace of the present invention is as shown in FIG. 1, a stationary non-tilting type melting furnace having electrodes 5 for arc heating and a pre-reducing iron feeding mechanism 9, in which melting is performed while keeping a refractory wearing index RF represented by the following equation at 400 MWV/$m^2$ or less.

$$RF=P\times E/L^2$$

[wherein RF represents a refractory wearing index (MWV/$m^2$); P represents an arc power for 1 phase (MW); E presents an arc voltage (V);and L represents the shortest distance (m) between the electrode side surface of the tip within an arc heating type melting furnace and the furnace wall inner surface.]

$$L=ID/2-PCD/2-DE/2$$

[wherein ID represents the inside diameter (m) of the melting furnace; PCD represents an electrode pitch circle diameter (m); and DE represents an electrode diameter (m).]

It is preferred that the inside diameter ID of the melting furnace is twice or more the furnace internal height IH (height from the bottom to the furnace roof) in order to ensure a sufficient molten iron holding quantity and the molten slag holding quantity while ensuring a free board zone (space in the furnace above the molten slag).

Figure 2:
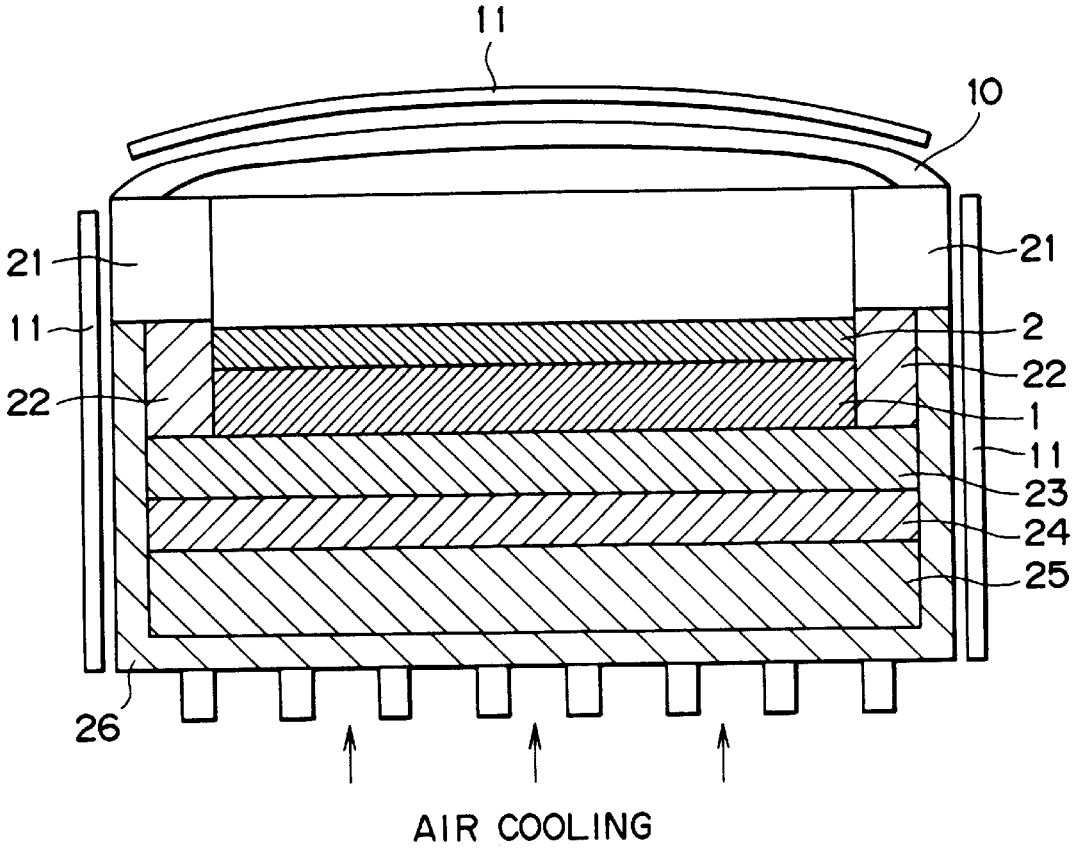
FIG. 2 illustrates an example of a cross section of a melting furnace with refractories according to the present invention.

With a view point of withstanding refractories erosion of the furnace inside wall, it is recommended that the melting furnace partially has a water-cooled structure and/or an air-cooled structure. The portion constituted as the water-cooled structure and/or air-cooled structure has no particular restriction and, optionally, the cooled structure may be provided only for a desired portion or, for example, the water-cooled structure is constituted, for the entire furnace. Alternatively, only the portion where the refractories tend to be damaged by melting such as the inside furnace wall portion in contact with the molten slag may be constituted as the water cooled structure. Alternatively, the furnace roof or furnace side wall may be constituted as a water-cooled structure as shown in FIG. 2 (in the drawing, are shown molten iron 1, molten slag 2, furnace roof 10, water-cooled structure 11, alumina carbon brick or magnesia carbon brick 21, 22, high alumina brick 23, 24, carbonaceous brick 25 and graphite brick 26). It will be apparent that other optional cooled structure than the water cooled structure such as an air cooled structure can optionally be adopted depending on the application use. For example, when the portion of the furnace wall in contact with the molten material in the furnace such as molten slags is constituted as a water-cooled structure, the temperature of the molten material in the furnace in contact with the water-cooled portion part can be lowered to withstand erosion of the refractories for the portion.

There is no particular restriction on the kind of the refractories but the furnace wall are preferably constituted with a refractory material mainly comprising at least one of brands selected from the group consisting of carbon, magnesia carbon and alumina carbon since the erosion resistance to to the molten material in the furnace is improved. Particularly, since such refractories have high erosion resistance to the molten slag, it is recommended to use them at a portion in contact with the molten slag. It is also recommended to constitute the outer circumference of such refractories with a refractory material mainly composed of graphite. Since the refractory mainly composed of graphite has high thermal conductivity, the effect for withstanding, erosion of the refractories in contact with the molten slag can be enhanced by the combination with the cooled structure.

Further, the furnace bottom in contact with the molten iron is preferably constituted with a refractory material having high erosion resistance to the molten iron and a refractory material mainly comprising at least one selected from alumina and magnesia is recommended for the refractory as described above. Further, it is desirable to dispose a material of high thermal conductivity such as refractory material mainly composed of graphite to the outside of the refractory at the bottom of the furnace since this can improve the effect of withstanding erosion.

In the present invention, the melting furnace preferably has a sealed structure in order to keep the atmosphere in the furnace. The sealed structure means such a structure that atmospheric air outside the furnace does not flow into and out of the inside of the furnace, thereby capable of substantially maintaining the atmosphere in the furnace. There is no particular restriction on the method of constituting the melting furnace to such a sealed structure. For example, the sealed structure of the melting furnace can be obtained by providing a seal portion 8 to a feeding mechanism for charging the material into the furnace such as a pre-reducing iron feeding mechanism 9, as well as by applying a nitrogen seal or ceramic seal ring by a known method to a portion tending to possibly lower the air tightness of the furnace, such as a joined portion between the furnace roof 10 and the furnace side wall, a portion of the furnace roof through which electrodes 5 pass, a contact portion between the feeding mechanism 9 and the furnace roof and a contact portion between an off-gas system 7 and a furnace roof portion. The sealed portion disposed, for example, to the pre-reducing iron feeding mechanism is a means for minimizing the lowering of the air tightness due to ingress of atmospheric air caused by the feeding of the pre-reducing iron. The sealed portion as described above can include known structures, for example, a combination of material seal by a hopper and a feeder for discharging the pre-reducing iron from the hopper with no particular restriction to them.

The pre-reducing iron 13 is fed by a pre-reducing iron feeding mechanism 9 to the melting furnace, in which the mechanism is preferably provided such that the pre-reducing iron can be fed in the electrode pitch circle diameter (PCD). When the pre-reducing iron is fed in the PCD (sometimes referred to as an electrode PCD), the iron can be melted efficiently by the arc heating mainly composed of radiation heating.

Further, in the present invention, the electrode tips are submerged in a slag layer 2 to generate the arc in the slag layer. Since the surface level of the slag layer (or layer thickness) moves vertically along with operation, it is recommended to vertically move the electrodes corresponding to the vertical change of the slag layer level in order to submerge the electrode tips in the slag layer. For vertically moving the electrodes, it is desirable that the electrodes are constituted as a movable type and the electrodes can be moved vertically by using a known electrode positioning mechanism such as a hydraulic cylinder or electric motor type (not shown). The electrodes used in this embodiment may be a known electrode and there is no particular restriction on the material or the like. The diameter DE and the length of the electrode vary depending on the melting operation of the furnace, the electric power supplied and the like and. Arc can be generated efficiently by using an electrode having a diameter DE of about 610 mm to 760 mm in a case where the melting operation of the furnace is, for example, from 80 to 100 t/h. There is no particular restriction on the length of the electrode and it may be sufficient that a length required for the vertical movement can be ensured in accordance with the furnace height IH or the molten iron holding quantity of the furnace.

Referring to the size of the melting furnace, a sufficient amount of molten iron to suppress the lowering of the molten iron temperature caused by the feeding of the pre-reducing iron or discharging of the molten iron can be kept in the furnace when the molten iron holding quantity is 3 times or more the molten iron production ability per hour in the furnace. Further, the chemical composition of the molten iron can be homogenized more easily when the molten iron quantity already present in the furnace is large enough compared to the molten iron quantity produced currently. Accordingly, it is desired to use a large scale furnace. However, if the molten iron holding quantity exceeds 6 times the molten iron production ability per hour, the radiation heat loss from the furnace body increases, to sometimes increase the operation cost for keeping the molten iron temperature.

When practicing the method of producing the molten iron according to the present invention to be described in details, the stationary non-tilting type melting furnace is used preferably.

This invention provides a technique of charging a pre-reducing iron as a raw material into a stationary non-tilting type melting furnace and melting the raw material by the arc heating mainly composed of radiation heating, to produce a molten iron. In the present invention, there is no particular restriction on the pre-reducing iron so long as it contains the iron component and the slag component and there is also no particular restriction on the shape. The pre-reducing iron can include, for example, direct reduced iron and iron scraps. Particularly, since the direct reduced iron is relatively uniform in the shape and the size and can be fed continuously to the melting furnace easily, it is recommended to use the direct reduced iron to be described later with a view point of the productivity of the molten iron.

Figure 3:
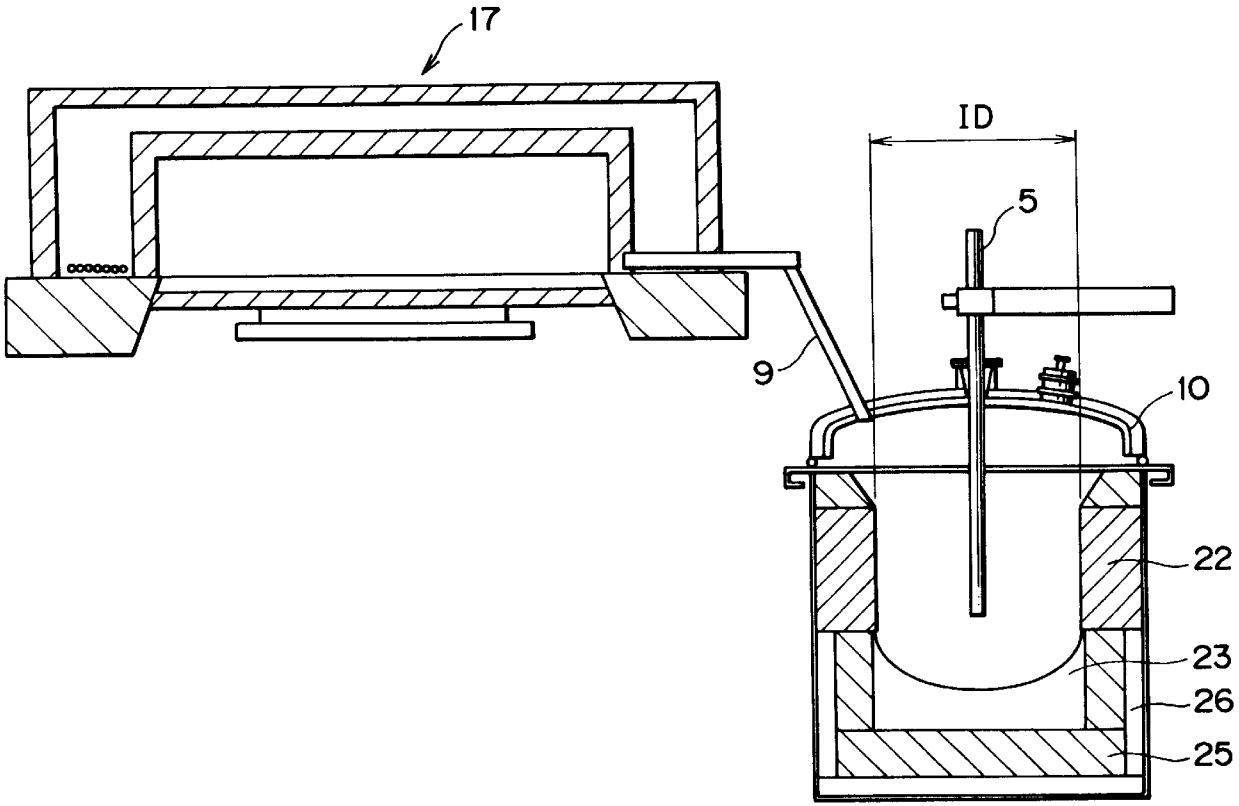
FIG. 3 illustrates an example of a stationary non-tilting type melting furnace according to the present invention.
Figure 4:
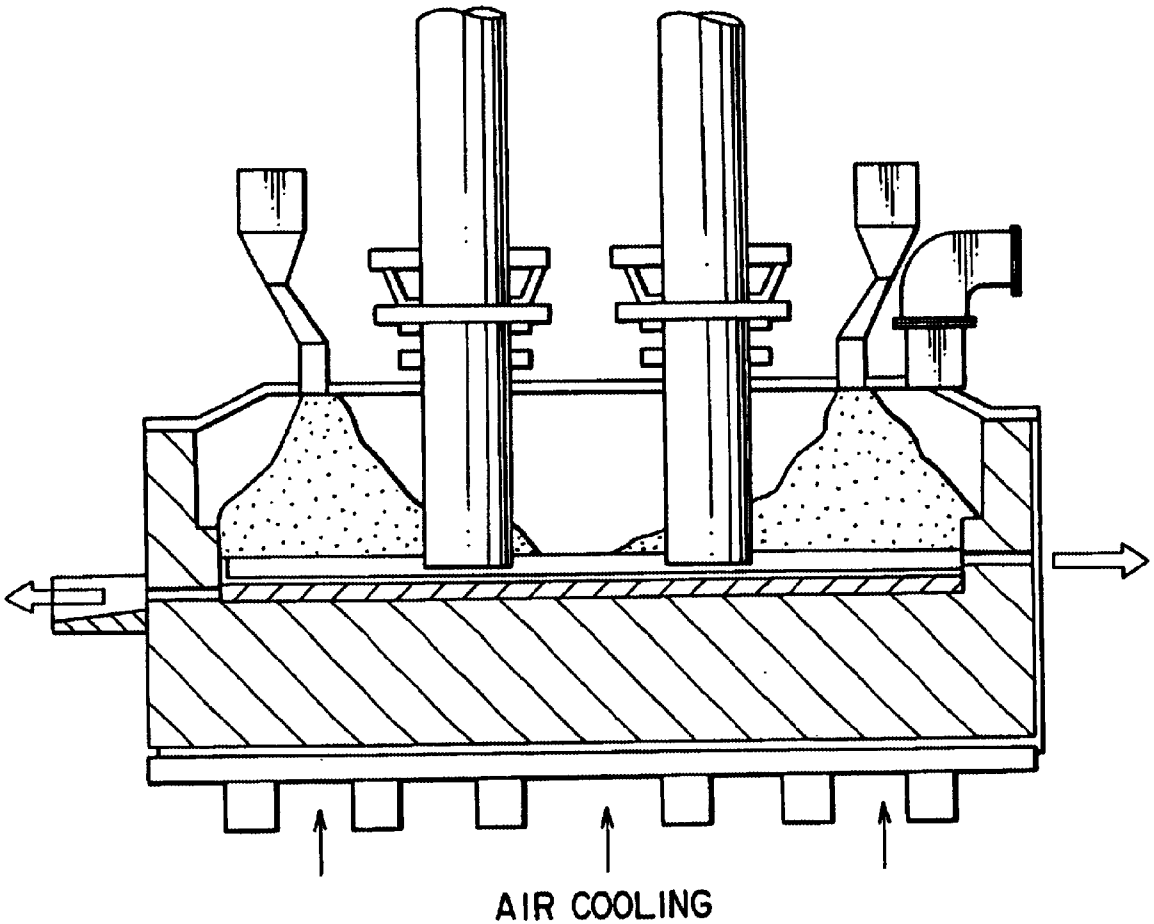
FIG. 4 PRIOR ART
FIG. 4 is a view illustrating a conventional submerged arc furnace.

The pre-reducing iron 13 is fed by the pre-reducing iron feeding mechanism 9 into the melting furnace, where it is preferred to feed the pre-reducing iron in the electrode PCD of the melting furnace in order to rapidly melt the pre-reducing iron. The pre-reducing iron may be fed continuously or intermittently with no particular restriction. Since the molten iron homogenized for the composition can be produced efficiently according to the method of the present invention, it is preferred to feed the pre-reducing iron continuously. For example, for feeding the direct reduced iron continuously into the melting furnace, the direct reduced iron produced continuously in a direct reduced iron production plant may be charged by a pre-reducing iron feeding, mechanism directly to the melting furnace. In this case, the direct reduced iron is preferably solid since the solid reduced iron can be transported easily irrespective of the shape and can be fed easily at a desired position such as in the electrode PCD by the pre-reducing iron feeding mechanism. The method of continuously feeding the direct reduced iron into the melting furnace is not restricted to a case of transporting and supplying the direct reduced iron discharged from a direct reduced iron production plant but it may be supplied from other direct reduced iron supply source, for example, a produced direct reduced iron may be stored and then the stored direct reduced iron may be transported and supplied. When the direct reduced iron produced in the direct reduced iron production plant is directly transported and supplied to the melting furnace, since there is no requirement for providing a storage facility or the like, the administration cost can be reduced. Further, since the direct reduced iron produced by the direct reduced iron production plant is at a high temperature, when it is directly transported and fed to the melting furnace, heat energy required for the melting of the direct reduced iron can be decreased. For example, as shown in FIG. 3, a direct reduced iron production plant 17 may be installed above the melting furnace and the solid reduced iron produced by the production plant may be fed gravitationally, for example, by dropping the same by way of a supply chute directly to the melting furnace. Since the direct reduced iron production plant is installed above the melting furnace as described above, facility for supplying the direct reduced iron from above the furnace (for example, a conveyor for supplying as far as a location above the melting furnace) is no more necessary and the entire facility can be made compact. In addition, when the direct reduced iron production plant is installed above the melting furnace, since the direct reduced iron can be fed easily to the melting furnace by the gravitational effect such as dropping, no additional charging facility is required. There is no particular restriction on conveying methods, and other conveying methods, besides gravity, are also envisioned.

The direct reduced iron production plant can include, for example, moving hearth type reduction furnace such as a rotary hearth furnace, straight grate; a vertical type furnace such as a shaft furnace; and rotary furnace such as a rotary kiln. Among them, the moving hearth type reduction furnace is preferred since the pre-reducing iron having a high metallization as described later can be produced continuously.

In the present invention, the metallization of the direct reduced iron to be fed into the melting furnace is preferably 60% or more. When a direct reduced iron with high metallization is used, the heat energy required for melting the direct reduced iron can be decreased. Further, since the molten FeO quantity in the by-produced slag is decreased as the metallization is higher, the iron yield can be improved and the erosion of refractory can be withstood as well. In view of the above, a preferred metallization is 80% or more and, more preferably, 90% or more. Further, when carbon is contained in the direct reduced iron to be fed, remaining iron oxide in the direct reduced iron can be reduced effectively in the melting furnace. A preferred carbon quantity (content) for obtaining such an efficient reducing effect is preferably 50% or more of the theoretical carbon quantity required for reducing the remaining iron oxide. Further, the specific gravity of the direct reduced iron is preferably 1.7 g/cm$^3$ or more since the direct reduced iron fed in the melting furnace is efficiently melted in the slag without being caught on the slag. U.S. Pat. No. 6,149,709 is referred to for the details of such direct reduced iron. Alternatively it is possible to directly charge carbonaceous material into the melting furnace to adjust carbon content of molten iron together with direct reduced iron. There is no particular restriction on the concrete carbon concentration and when the carbon concentration is determined in accordance with the concentration of molten FeO, it is preferred that the carbon concentration is, for example, from 1.5% to 4.5% (concentration in the molten iron) in order to provide the effect of reducing molten FeO.

Carbonaceous material and auxiliary raw materials such as lime are contained in the direct reduced iron, and may alternatively be directly charged into the melting furnace together with the direct reduced iron by a pre-reducing iron feeding mechanism (not shown) into the melting furnace, or may be charged into the melting furnace by a feeding mechanism disposed separately from the pre-reducing iron feeding mechanism, with no particular restriction on the charging method. When the carbonaceous material and the auxiliary raw material are fed into the furnace, it is desirable that they are fed in the electrode PCD like the case for pre-reducing iron.

Explanation is to be made for the case of using direct reduced iron as the pre-reducing iron. As shown in FIG. 1, the direct reduced iron 13 fed in the electrode PCD is melted by the heating mainly composed of radiation heating by the arc 4 from the electrode tips submerged in the molten slag layer 2 to form the molten iron and form the molten slag as by products. Electric power is supplied to the electrodes 5 from a power supply device (not shown) and it is recommended to make the arc 4 from the electrode tip longer in order to generate a sufficient radiation heating to melt the direct reduced iron and melt the direct reduced iron at a high efficiency. In view of the above, the power factor is desirably 0.65 or higher.

Most of remaining iron oxide in the charged direct reduced iron is reduced before melting of the direct reduced iron by the carbon remained in the direct reduced iron and the atmosphere in the furnace becomes reducing by a gas mainly comprising carbon monoxide generated by the reducing reaction of the remaining iron oxide. Accordingly, the metallization of the direct reduced iron is improved and the quantity of molten FeO formed is decreased. The charged direct reduced iron is melted when reaching a melting temperature to form the molten slag and molten iron, where the molten slag forms a molten slag layer and the molten iron precipitates through the molten slag layer and forms a molten iron layer.

Further, when the melting furnace is constituted as a sealed structure, the inside of the furnace can be filled with carbon monoxide formed by the reducing reaction of iron oxide remaining in the direct reduced iron to keep a preferred reductive atmosphere for reduction, promotion of desulfurization or the like. In addition, oxidation loss of carbon in the direct reduced iron and carbonaceous material to be directly charged into the furnace is decreased to improve the yield.

Figure 5A:
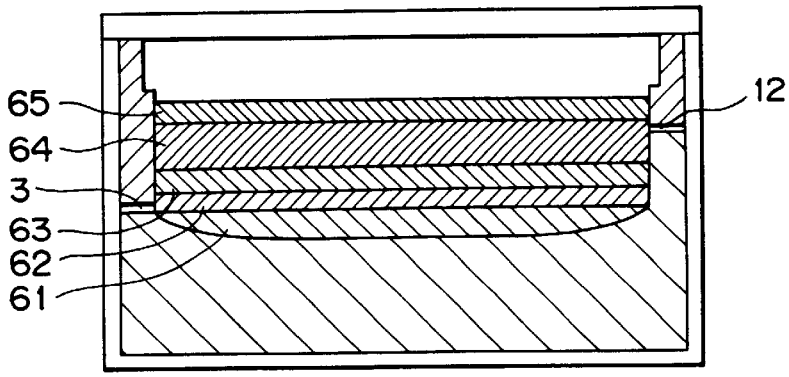
FIG. 5 illustrate examples of states of melting furnace according to the present invention
Figure 5B:
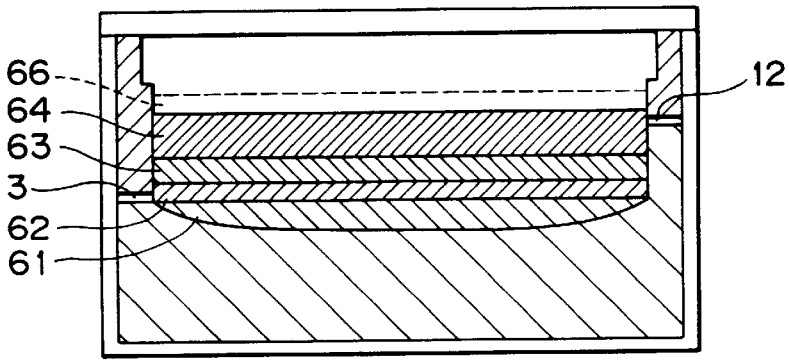

Typical state in the furnace for increase and decrease of molten slag and molten iron in the operation when the direct reduced iron is continuously fed in the electrode PCD by way of the pre-reducing iron feeding mechanism 9 into the stationary non-tilting arc heating type melting furnace is to be explained with reference to FIG. 5. In FIG. 5, are shown molten iron layers 61, 62 and 63, molten slag layers 64 and 65, decrease 66, 68 for the molten slag layer after discharging the molten slag and decrease 67 for the molten iron layer after discharging the molten iron. The charged direct reduced iron is continuously melted by arc heating and the level for each of the molten slag layer and the molten iron layer is increased (refer to FIG. 5A, in which 65, 63 represents increment for each of them). When the surface level of the molten iron (upper surface) (hereinafter referred to as a molten iron level) reaches a predetermined height below the slag discharging hole 12, or when the surface level of the molten slag (upper surface) (hereinafter referred to as a molten slag level) reaches a predetermined height, the molten slag is discharged from the slag discharging hole 12 to start control for the molten slag level. When the molten slag level lowers beyond the upper position of the hole diameter of the slag discharging hole, atmospheric air intrudes through the hole to disturb the reductive atmosphere in the melting furnace. Further, if the thickness of the slag layer is decreased excessively, it can not completely cover the arc to lower the heat efficiency. Accordingly, it is desirable to stop the discharge of the molten slag, for example, by closing the slag discharging hole at the instance the molten slag level lowers to a position somewhat higher than the upper position of the hole diameter of the slag discharging hole and at a position where the molten slag keeps the thickness required for covering the arc from the electrodes (FIG. 5B). The slag discharging hole 12 may be opened from the outside of the melting furnace, for example, by a tapping machine and the method of disposing the slag discharging hole is not restricted particularly. Further, oxygen or like other gas may be blown by a gas supplying mechanism (not shown) into the furnace with an aim of promoting discharge of the molten slag, or a melting promoter such as fluorite may be added to promote discharge of the molten slag from the slag discharging hole. The temperature of the molten iron layer is preferably 1350° C. or higher, since melting of the slag component is promoted to facilitate discharging of the slag.

Figure 5C:
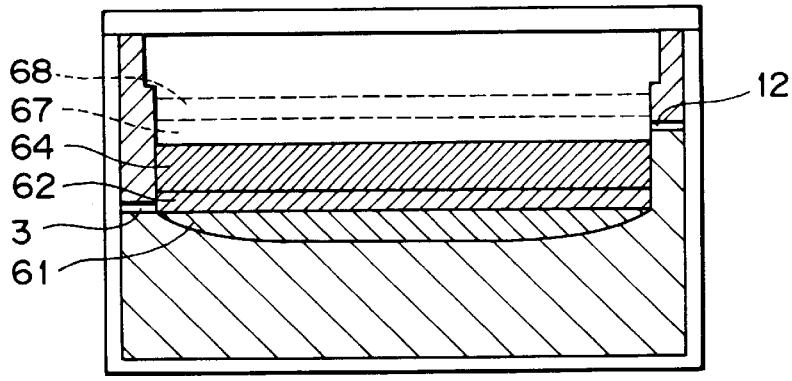

Also for the molten iron layer, the molten iron level may be controlled by discharging the molten iron from the molten iron discharging hole 3 at the instance the molten iron level reaches a predetermined value (height). However, since the molten slag can not be discharged after the lowering of the molten iron level, it is recommended to control the molten slag level by the procedures described above prior to the control of the molten iron level. There is no particular restriction on the lower limit of the molten iron level when the molten iron level is decreased but the molten slag may sometimes be discharged together with the molten iron if the molten iron level lowers beyond the upper position of the hole diameter of the molten iron discharging hole. Accordingly, it is desirable to control the molten iron level such that it is above the upper position of the hole diameter of the molten iron discharging hole. It is desirable to stop the discharging of the molten iron, for example, by closing the molten iron discharging hole at the instance the molten iron level lowers to an allowable position capable of satisfying such a condition (FIG. 5C).

In a case of continuously charging the direct reduced iron, the molten iron discharging quantity is preferably controlled such that about ½ of the maximum molten iron holding quantity of the melting is remained, by which fluctuation of the composition of the molten iron due to the charged direct reduced iron can be suppressed to make the composition of the discharged molten iron uniform and the lowering of the molten iron temperature caused by the charging of the direct reduced iron can be suppressed. The molten iron discharging hole 3 may be opened from the outside of the melting furnace, for example, by a tapping machine and there is no particular restriction on the method of disposing the molten iron discharging hole.

Referring to the control for the molten slag level and the molten iron level, the molten iron level is basically controlled after controlling the molten slag level but the level may optionally be controlled by discharging the slag and the molten iron independently of each other. Further, discharging of the slag and/or the discharging of the molten iron may be conducted while supplying the direct reduced iron continuously or intermittently.

It is desirable to control the electrode tips to be situated in the molten slag layer by vertically positioning the electrodes in accordance with the vertical movement of the molten slag level by using a movable type electrode. The electrodes may be moved vertically in accordance with the vertical movement of the molten slag level by using an automatic electrode control device (not shown). The automatic electrode control device is a device capable of detecting arc current and voltage and capable of positioning the electrodes so as to keep the ratio thereof (furnace impedance) to a set value.

When the direct reduced iron is supplied to the stationary non-tilting type melting furnace and melting the direct reduced iron by an arc heating mainly composed of radiation heating, since furnace wall refractories in contact with the molten slag may sometimes be lost by arc radiation, it is recommended to conduct melting while keeping a refractory wearing index RF represented by the following equation at 400 MWV/m$^2$ or less:

$$RF=P\times E/L^2$$

[wherein RF represents a refractory wearing index (MWV/m$^2$); P represents an arc power for one phase (MW); E represents an arc voltage (V); and L represents the shortest distance (m) between the electrode side surface of the tip within the arc heating furnace and the furnace wall inner surface.]

The reduced iron melting ability of the melting furnace can be maintained while decreasing the thermal load on the refractories by properly controlling the values described above.

As the refractory wearing index is higher, the furnace wall refractories are damaged violently to need repairing by several times per one day, thus making the continuous operation difficult. Since the erosion of the furnace wall refractories in contact with the melting slag caused by arc radiation can be withstood when the refractory wearing index is 400 MWV/m$^2$ or less, continuous operation is possible. Particularly, the refractory wearing index of 200 MWV/m$^2$ or less is preferred since the thermal load on the furnace wall refractories is decreased and the life time of the refractories is improved remarkably to enable long time continuous operation.

Further, depending on the direct reduced iron supplied, the composition of the slag component such as $SiO_2$, $Al_2O_3$ and CaO derived from the gangue component of the iron ores used as the raw material and the ash content in the carbon material, and the reduction ratio of the direct reduced iron may sometimes vary. Accordingly, in order to eliminate the compositional difference in the discharged molten iron and obtain homogenous molten iron efficiently, it is desirable to control the molten iron holding quantity in the melting furnace to 3 times or more the molten iron production ability of the furnace. When the molten iron holding quantity is controlled to 3 times or more, the quality of the molten iron is stabilized by the dilution effect of the molten iron quantity which is larger compared with the amount of the direct reduced iron charged while suppressing the lowering of the molten iron temperature caused by charging of the direct reduced iron or discharging of the molten iron. That is, molten iron of homogenized composition can be obtained. However, when the molten iron holding quantity increases to 6 times or more, the radiation heat loss from the furnace body is increased compared with the producing quantity of the molten iron to results in increasing the electric power unit.

When the furnace inside diameter is set so as to keep the molten iron holding quantity three to six times the molten iron production ability and such that the melting furnace inside diameter is twice or more the internal height of the furnace, the furnace inside diameter becomes large with respect to the molten iron production ability, that is, the arc power, and RF can be controlled easily to 400 MWV/m$^2$ or less.

EMBODIMENT

Embodiment 1

The state of erosion of furnace wall refractories (portion of a furnace wall 22 in contact with molten slag) was examined by using a small sized experimental molten iron producing facility shown in FIG. 3.

| | |
|---|---|
| Target molten iron producing quantity per hour: | about 100 kg/h |
| Total operation hours: | 120 hrs |
| Arc power for one phase: | 86 kW/phase |
| Arc voltage: | 40 V/phase |
| Molten iron discharging pressure: | static pressure |
| Molten iron discharging cycle: | 250 kg on every 2.5 hrs |
| Maximum molten iron holding quantity: | 500 kg |
| Molten iron temperature in the furnace: | 1550° C. |

Furnace wall refractory structure:

Furnace wall portion 22; magnesia chromium brick

Furnace wall bottom 23; high alumina brick

Melting furnace:

Stationary non-tilting arc heating type melting furnace

| | |
|---|---|
| Melting furnace inside diameter ID: | 762 mm. |
| Electrode PCD: | 89 mm |
| Electrode diameter DE: | 76 mm |
| Furnace internal height IH: | 762 mm |

Electrodes for arc heating; movable type (power factor 0.8); controlled such that the tips of electrodes always submerged in the slag layer. Only one electrode is shown in FIG. 3 since the drawing is a cross sectional view, but two electrodes were used actually.

Direct reduced iron produced in a rotary hearth furnace (metallization 80 to 90%, temperature 1000° C.) was supplied by a mechanism to the melting furnace. The slag and the molten iron were discharged through a slag discharging hole (not shown) and a molten iron discharging hole (not shown) appropriately when reaching at a predetermined height. The refractory wearing index was 50 MWV/m$^2$ and no damages to the furnace wall refractories were observed in the investigation after the completion of the testing.

Embodiment 2

Figure 6:
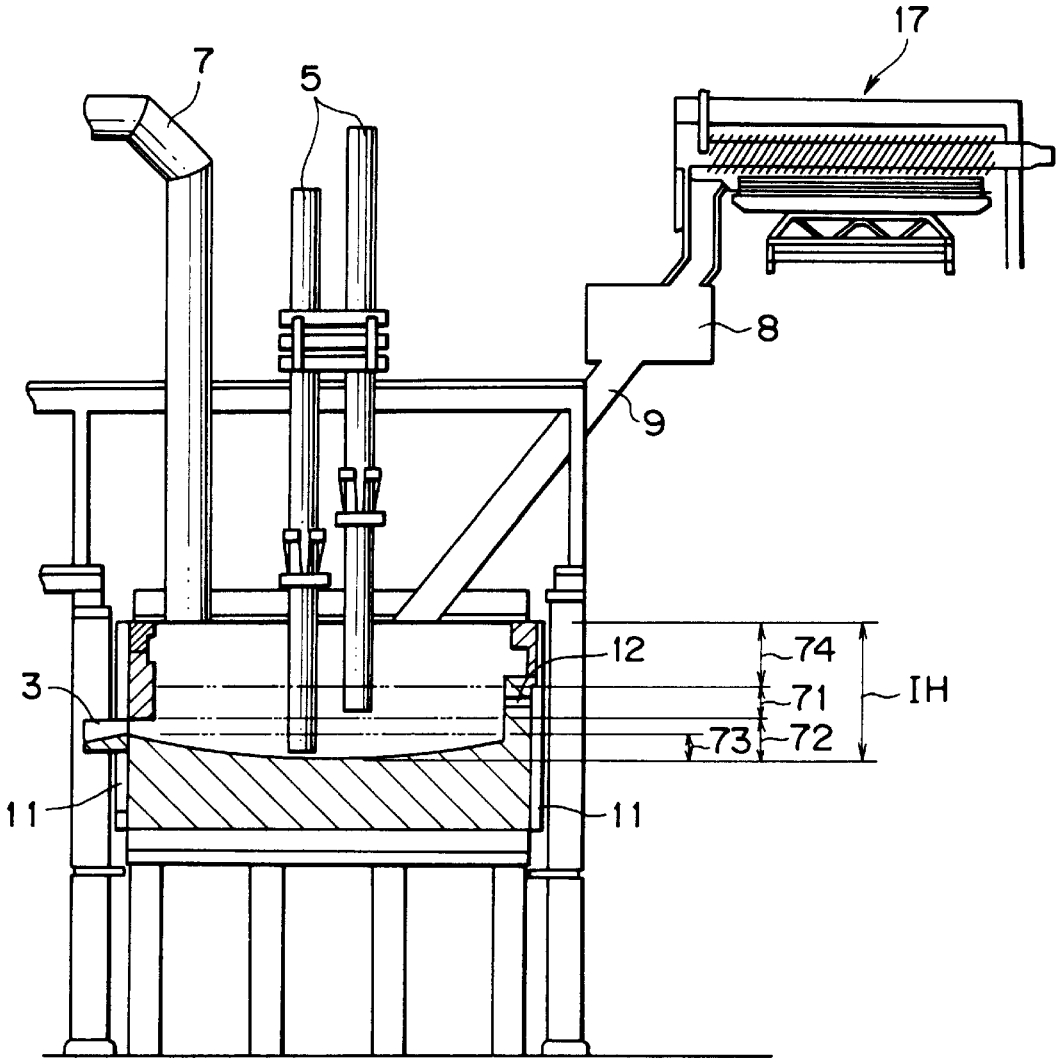
FIG. 6 illustrates an example of a stationary non-tilting type melting furnace according to the present invention.

Direct reduced iron produced in a reduced iron producing plant 17 (rotary hearth furnace) shown in FIG. 6 (about 1000° C.) is supplied to a stationary non-tilting arc heating type melting furnace. The reduced iron producing plant 17 is installed above the melting furnace and the direct reduced iron discharged while hot (not shown) is supplied by a reduced iron feeding mechanism 9 having a material seal portion 8 directly into the melting furnace and charged in the electrode PCD. The direct reduced iron supplied has a metallization of 90% and a carbon content of 4%. Further, lime is charged by a feeding mechanism disposed separately (not shown). The direct reduced iron producing quantity in the reduced iron producing plant is controlled such that the amount of the direct reduced iron supplied to the melting furnace provided the molten iron producing quantity described below. The melting furnace in this example has a inside diameter of the melting furnace of 8530 mm, the electrode PCD of 1524 mm, the electrode diameter of 610 mm and the furnace internal height IH of 3375 mm, the shortest distance between the electrode side surface of the tip within the arc heating furnace and the furnace wall inner surface of 3198 mm and the maximum molten iron holding quantity of 300 t. The refractory at the furnace wall portion is formed of alumina carbon brick and the refractory at the furnace bottom is formed of a high alumina brick. Further, the outer circumferential side (outside) of each of the refractories is formed of a refractory mainly composed of graphite brick. Further, in the furnace used in this example, the furnace wall portion and the roof portion have a water cooled structure and the furnace bottom portion has an air cooled structure. Further, for maintaining the atmosphere in the furnace (carbon monoxide), the joined portion between the furnace wall and the furnace roof is sealed with a seal ring, a seal portion 8 is disposed to the feeding mechanism and the inside of the furnace is constituted as a sealed structure. Although not illustrated, the off-gas mechanism 7 is also adapted such that the off gas can be discharged to maintain the furnace atmosphere and the ingress of outside air is shut. Operation is conducted under the following conditions and 136 ton of molten iron is discharged on every 105 minute interval from the molten iron discharging hole 3.

| | |
|---|---|
| Target molten iron producing quantity per hour: | about 78 t/h |
| Arc power for one phase: | 15 MW/phase |
| Arc voltage: | 188 V/phase |
| Refractory wearing index: | 280 MWV/m$^2$ |
| Molten iron discharging pressure: | static pressure |
| Molten iron temperature in the furnace: | 1550° C. |

Operation is conducted while continuously supplying direct reduced iron into the melting furnace, and 136 t of molten iron is discharged from the molten iron discharging hole 3 at the instance the molten iron quantity in the furnace reaches 300 t and, subsequently, it is discharged each by 136 t on every 105 minute interval. Accordingly, the remaining molten iron quantity in the furnace after discharging 136 t of molten iron is 164 t on every discharge. Further, while the molten iron level in the furnace moved vertically by formation and discharging of the molten iron, in which the vertical range is 1040 mm from the furnace bottom before discharging and 580 mm from the furnace bottom after discharging, and the vertical movement of the molten iron level is 460 mm. The upper position of the hole diameter of the molten iron discharging hole 3 is set as 380 mm from the furnace bottom. Further, the molten slag is discharged properly from the slag discharging hole 12 such that the maximum height of the molten material in the furnace does not exceed 1800 mm (height from the furnace bottom to the surface of the slag layer 71+72). The height for each of the layers when the molten material height in the furnace reaches 1800 mm in this example is 760 mm for the molten slag layer height 71 and 1041 mm for the molten iron layer height 72 (free board region 74: 1575 mm). Electrodes for arc heating are a vertically movable type by hydraulic cylinders depending on the vertical movement of the slag layer (while two electrodes are shown in the drawing, three electrodes are actually installed, each electrode in the drawing showing that they are movable independently of each other, the position in the drawing being different from the electrode tip position during operation). The molten slag is remained by a considerable amount such that the electrode tips are submerged in the slag layer even after the discharging of the slag. Further, the power factor of the power supplied to electrodes for arc heating 5 is controlled at 0.75 to 0.85 by a power supply system(not shown). The refractory wearing index in this example is less than 400 MWV/$m^2$ and refractories on the furnace wall and the hearth are scarcely damaged.

According to the present invention, erosion of the furnace wall refractories in the melting furnace could be withstood to make the furnace life longer. Further, molten iron with homogenized composition could be obtained while maintaining high productivity. Further, since the direct reduced iron of high metallization produced in and transported from the reduced iron producing plant was directly charged into the melting furnace, a molten iron having more homogenous and predetermined composition could be obtained at a higher efficiency while extending the life of refractories than usual to make the continuous operation possible.

We claim:

1. A method for producing molten iron comprising:

supplying a pre-reducing iron to a stationary non-tilting type melting furnace having electrodes, at a position within a pitch circle diameter of the electrodes; and melting the iron by an arc heating mainly composed of radiation heat, the melting being performed while keeping a refractory wearing index RF represented by the following equation at 400 MWV/$m^2$ or less:

$$RF=P\times E/L^2$$

wherein RF represents the refractory wearing index (MWV/$m^2$); P represents the arc power for one phase (MW); E is the arc voltage (V); and L represents the shortest distance between the electrode side surface of the tip within an arc heating type melting furnace and the furnace wall inner surface (m).

2. A method for producing molten iron according to claim 1 wherein the maximum molten iron holding quantity of the melting furnace is larger than the molten iron production ability per hour in the melting furnace.

3. A method for producing molten iron according to claim 2 wherein the maximum molten iron holding quantity is 3 to 6 times the molten iron production ability per hour.

4. A method for producing molten iron according to claim 1 wherein the tips of electrodes for arc heating, in the melting of the pre-reducing iron by arc heating, are submerged in the slag layer of the molten slag by-produced by melting the iron.

5. A method for producing molten iron according to claim 4 wherein the power factor of the power supplied to electrodes for arc heating is set to 0.65 or more.

6. A method for producing molten iron according to claim 1 wherein the melting furnace is laid in a reductive atmosphere in the melting of the pre-reduced iron by arc heating.

7. A method for producing molten iron according to claim 1 wherein the pre-reduced iron is direct reduced iron.

8. A method for producing molten iron according to claim 7 wherein the metallization of the direct reduced iron is 60% or more.

9. A method for producing molten iron according to claim 7 wherein the molten iron produced by the melting of the direct reduced iron is discharged out of the furnace in the state of 1350° C. or higher.

10. A method for producing molten iron according to claim 8 wherein the carbon content of the molten iron is 1.5 to 4.5 mass %.

11. A stationary non-tilting arc heating type melting furnace for melting a pre-reducing iron by arc heating mainly composed of radiation heat, the melting furnace having a pre-reducing iron feeding mechanism, electrodes for an arc heating and a molten iron discharging mechanism, the melting being performed while keeping a refractory wearing index RF represented by the following equation at 400 MWV/$m^2$ or less:

$$RF=P\times E/L^2$$

wherein RE represents the refractory wearing index (MWV/$m^2$); P represents the arc power for one phase (MW); E is the arc voltage (V); and L represents the shortest distance (m) between the electrode side surface of the tip within the arc heating furnace and the furnace wall inner surface, and $$L=ID/2-PCD/2-DE/2$$

wherein ID represents the inside diameter (m) of the melting furnace; PCD represents the electrode pitch circle diameter (m); and DE represents the electrode diameter (m), and wherein the pre-reducing iron feeding mechanism comprises means for introducing pre-reducing iron into the furnace at a position within the PCD.

12. A stationary non-tilting type melting furnace according to claim 11 wherein the inside diameter ID of the melting furnace is 2 times or more the furnace internal height IH.

13. A stationary non-tilting type melting furnace according to claim 11 wherein the melting furnace partially has a water-cooled structure and/or an air-cooled structure.

14. A stationary non-tilting type melting furnace according to claim 11 wherein the inside of the furnace wall refractory material of the melting furnace is formed of a refractory material mainly composed of at least one selected from the group consisting of carbon, magnesia carbon, and alumina carbon.

15. A stationary non-tilting tpe melting furnace according to claim 14 wherein the outside of the furnace wall refractory material of the melting furnace is formed of a refractory material mainly composed of graphite.

16. A stationary non-tilting type melting furnace according to claim 11 wherein the inside of the furnace bottom of the melting furnace is formed of a refractory material mainly comprising at least one selected from alumina and magnesia.

17. A stationary non-tilting type melting furnace according to claim 16 wherein the outside of the bottom of the melting surface is formed of a refractory material mainly composed of graphite.

18. A stationary non-tilting type melting furnace according to claim 11 wherein the melting furnace has a sealed structure.

19. A stationary non-tilting type melting furnace according to claim 11 wherein the pre-reducing iron feeding mechanism is constituted so as to supply the pre-reducing iron into the furnace through a seal part.

* * * * *